United States Patent [19]

Kern

[11] 4,020,437

[45] Apr. 26, 1977

[54] RELAY HAVING TWO WINDING SUPPORTS

[75] Inventor: Josef Kern, Berlin, Germany

[73] Assignee: Siemens Aktiengesellschaft, Munich, Germany

[22] Filed: Jan. 27, 1975

[21] Appl. No.: 544,514

[30] Foreign Application Priority Data

Jan. 25, 1974 Germany ..... 2403622

[52] U.S. Cl. ..... 335/299; 336/199

[51] Int. Cl.[2] ..... H01F 5/00

[58] Field of Search ..... 335/256, 259, 264, 278; 336/65, 199, 208, 198; 242/118.41

[56] References Cited

UNITED STATES PATENTS

| | | | |
|---|---|---|---|
| 2,667,624 | 1/1954 | Bels | 336/208 |
| 3,191,135 | 6/1965 | Hazelquist | 336/65 |
| 3,244,941 | 4/1966 | Maynard et al. | 336/65 X |
| 3,605,055 | 9/1971 | Grady | 336/208 |
| 3,689,862 | 9/1972 | Hilgers | 336/208 |

*Primary Examiner*—J D Miller
*Assistant Examiner*—Fred E. Bell
*Attorney, Agent, or Firm*—Gerald L. Lett

[57] ABSTRACT

A relay structure having two winding supports axially aligned on opposite sides of a mounting plate is described. The winding supports are designed as coil forms having flange members placed on the ends thereof. The flange members nearest the mounting plate on each coil form have, respectively, projections and corresponding recesses capable of an interference fit.

3 Claims, 2 Drawing Figures

RELAY HAVING TWO WINDING SUPPORTS

BACKGROUND OF THE INVENTION

The invention relates to a relay construction having two winding supports aligned axially of the two sides of a mounting plate.

This type of relay is frequently employed in relay arrays, i.e., a plurality of relays are arranged side by side by means of a common mounting plate. In so doing, component parts of the magnetic and electrical paths formed by contact plates are often shared by several or even all such relays, channels being formed by plastic guides for the parts forming the iron or current paths into which the windings must be inserted. A commonly known technique is to slide self-supporting coils into winding supports disposed in the channels and to hold the same in place by means of adhesives.

An object of the invention is to provide an improved relay construction having relay windings inserted into the guide channels.

The foregoing and other objects are accomplished in that the winding supports designed as coil forms with flanges carry on a flange turned toward the mounting plate in an assembly stage fixing elements constructed as pins disposed in recesses of the mounting plate, of as shafts, likewise, disposed in recesses and clampingly receiving, during the assembly, the pins of the other coil form.

An important element of the invention is the fact that in addition to the insertion of the two axially winding supports into the corresponding guide channels and securing the two coil forms to the mounting plate during this insertion, no further production steps are required. By contrast, in prior relay arrays an adhesive droplet must be applied on both sides of the mounting plate, which must be done with utmost accuracy and care in view of the deleterious effects that could be caused when moving parts of the relay are soiled with adhesive.

In addition to achieving an interference fit of the coil forms without additional fixing means or bonding agents and the advantage that the mounting in the form of a plug-in assembly can very easily be automated, another important feature of the invention resides in the fact that no loss of window or winding space results from the clamping of the coil forms; the flanges of the coil forms bear directly against the mounting plate. Though prior clamp connections for can-shielded coils likewise provide pins on the can covers, these pins reach through recesses of a mounting plate shared by several shielding cans, as well as through slots made in the shielding-can covers lying opposite.

The total utilization, achieved within the framework of the invention, of the guide channel for the coil form with wound coil allows the interchangeability of the self-supporting coil of known construction with the coil with coil forms employed within the framework of the invention, as the additional space required by the coil form can, within certain limits, be compensated through the use of wires in conformity with the structure of a self-supporting coil without a thermoplastic covering that causes the individual coils to cake or bond as a result of termal effects.

It is of advantage in this context to use the winding support employed for prior relay arrays as a coarse adjusting guide for the coil forms. Thus, great interexchangeability is achieved for the self-supporting coils with the form-wound coils and between the form-wound coils themselves.

The joining of two winding supports into a single relay or a relay in an array having partly common components is achieved according to an advantageous development of the invention through the provision of an identical number of pins and shafts of the terminal flange of the coil forms. The pins and shafts are distributed such that one form of construction of the coil forms allows the interconnection of two coil forms. This feature can be achieved through a great variety of distributions, whereby in the case of a relatively small number of pins and carrier flanges a diagonal arrangement of two identical fixing means is preferred.

An accurate and permanent fixed interconnection of two coil forms can particularly be achieved if the shafts are designed as flanges having a circular section and provided with radial ribs. The ribs are designed such that taking into consideration the properties of the material of the coil-form flange, they can be deformed plastically upon insertion of the pins of the associated coil form.

On balance, the invention enables the construction of relays whose windings can be combined according to one's choice in a single inexpensive manufacturing process, whereby great independence of the tolerances of the mounting plate can be achieved as a result of the floating mounting of the two coil forms on the mounting plate.

BRIEF DESCRIPTION OF THE DRAWINGS

The principles of the invention will be more readily understood by reference to the description of a preferred embodiment given hereinbelow in conjunction with the accompanying drawings of a relay constructed according to the invention, which are briefly described as follows.

DETAILED DESCRIPTION OF THE DRAWINGS

Figure 1:
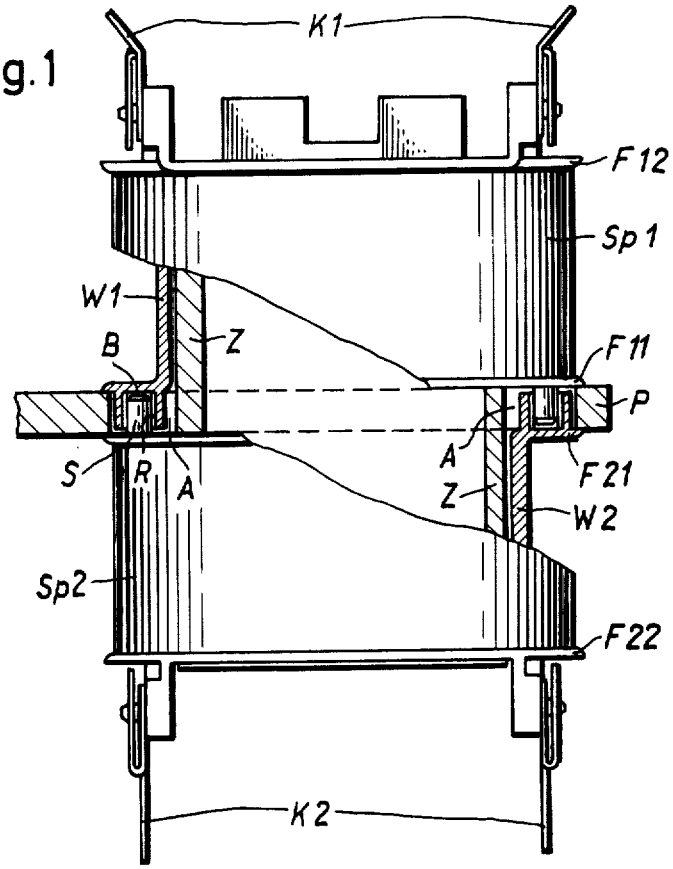
FIG. 1 is a longitudinal section of two coil forms connected in the area of a mounting plate.

The exciting windings of the relays shown in FIG. 1 are formed by the two coils S*p*1 and S*p*2 each being disposed, respectively, on a coil form W1 and W2, each coil form has two flanges F11, F12 and F21, and F22. Flanges F12 and F22 are the supports of the connecting contact lugs K1 and K2, while the flanges F11 or F21 turned toward the mounting plate P are provided with pins S or sleeves B, so that the coils S*p*1 and S*p*2 can be held in position on the mounting plate. To fasten the coils S*p*1 and S*p*2, the coil forms W1 or W2 are slid over centering guides Z so that in recesses A of the mounting plate P the pin S of the support flange, e.g., F21, and the sleeves of the support flange (F11) of the other coil form (W1) face each other. By applying an appropriate force in the direction of the axes of the two coil forms W1 or W2, the pins S which have a certain interference fit with respect to the inside diameter defined in the sleeves B by the ribs R, are pushed down in accordance with a clamp connection. The pins S and the sleeves are designed such that a tight fit of the flange F11 or F21 against the mounting plate P is assured.

Figure 2:
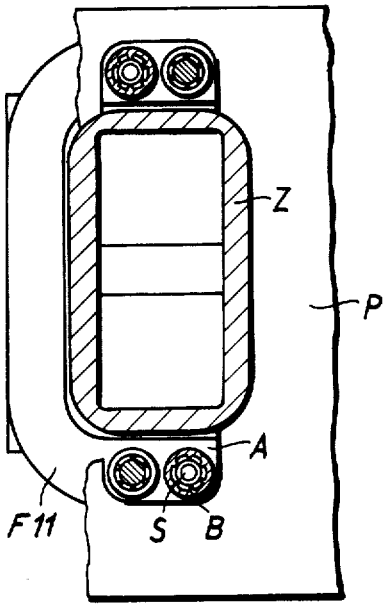
FIG. 2 is a cross section of the mounting plate in the FIG. 1 embodiment.

FIG. 2 shows that each of the tight-fitting flanges in the area of the mounting plates P (of which only flange F11 is visible) has two sleeves and two pins S in a diagonal arrangement. Thus, regardless of the position of the flanges (F11) in relation to the centering guide Z, the pin of one flange always coincides with the sleeve of the other flange.

The invention is described herein in terms of a preferred embodiment which should be considered only to be exemplary. It is contemplated that the described embodiment can be modified or changed while remaining within the scope of the invention as defined by the appended claims.

I claim:

1. In a relay having at least a pair of axially aligned winding supports constituting coil forms, said winding supports comprising:

flange members on at least the adjacent ends of said coil forms, each said flange member having pins and recesses thereon, the said recesses on a given flange member having a configuration and being located as to receive and engage the said pins on an opposing said flange member on an adjacent coil form and a mounting plate interposed between said adjacent coil forms and having an opening defined therein, said opening being located so that the said engaged pins and recesses extend therethrough, said engaged pins and recesses being substantially entirely within said openings.

2. The relay defined in claim 1 further comprising:

guide means for guiding said coil forms on to said mounting plate.

3. The relay defined in claim 1 wherein said recesses are circular and have ribs therein constructed to plastically deform upon insertion of said pins.

* * * * *